United States Patent [19]

Fukuroi

[11] Patent Number: 4,513,482

[45] Date of Patent: Apr. 30, 1985

[54] FLUID-TIGHT SLIDE FASTENER STRINGER

[75] Inventor: Takeo Fukuroi, Uozu, Japan

[73] Assignee: Yoshida Kogyo K. K., Tokyo, Japan

[21] Appl. No.: 603,988

[22] Filed: Apr. 26, 1984

Related U.S. Application Data

[63] Continuation of Ser. No. 410,130, Aug. 20, 1982, abandoned.

[30] Foreign Application Priority Data

Aug. 20, 1981 [JP] Japan ..... 56-129440

[51] Int. Cl.[3] ..... A44B 19/00

[52] U.S. Cl. ..... 24/384; 24/389; 24/410; 24/414

[58] Field of Search ..... 24/381, 384, 387, 389, 24/410, 413, 414, 433, 434

[56] References Cited

U.S. PATENT DOCUMENTS

| | | | |
|---|---|---|---|
| 2,557,163 | 6/1951 | Williams | 24/205.1 R |
| 2,746,113 | 5/1956 | Williams | 24/205.1 R |
| 2,791,017 | 5/1957 | Mulka | 24/205.1 R |
| 2,910,754 | 11/1959 | Morin | 24/205.1 R |
| 2,969,029 | 1/1961 | Morin | 24/205.1 R |
| 3,114,953 | 12/1963 | Doelter | 24/205.1 R |
| 3,990,130 | 11/1976 | Hattori | 24/205.11 R |
| 4,078,279 | 3/1978 | Heimberger | 24/205.11 R |
| 4,221,026 | 9/1980 | Kanzaka | 24/205.11 R |
| 4,312,102 | 1/1982 | Fukuroi | 24/205.16 R |

FOREIGN PATENT DOCUMENTS

| | | | |
|---|---|---|---|
| 1049325 | 1/1959 | Fed. Rep. of Germany D | 24/205.13 |
| 723998 | 2/1955 | United Kingdom | 24/205.11 R |

*Primary Examiner*—John J. Wilson
*Assistant Examiner*—James R. Hakomaki
*Attorney, Agent, or Firm*—Hill, Van Santen, Steadman & Simpson

[57] ABSTRACT

A fluid-tight slide fastener stringer comprising a support tape made of a fluid-tight soft material, and a row of discrete coupling elements mounted on the tape along an inner longitudinal edge portion thereof. Such tape margin is folded so as to provide therealong a contact portion engageable with a corresponding contact portion of a like companion stringer to effect a fluid-tightness between the two stringers. In order to absorb or reduce undue stress exerted on the individual coupling elements, each coupling element has a slot extending parallel to the general plane of the stringer transversely through the whole width of a coupling head portion and also extending longitudinally of the same coupling element through the coupling head portion into a base portion.

7 Claims, 3 Drawing Figures

FLUID-TIGHT SLIDE FASTENER STRINGER

This application is a continuation of application Ser. No. 410,130, filed Aug. 20, 1982, now abandoned.

BACKGROUND OF THE INVENTION

1. Field of the Invention:

The present invention relates to slide fasteners, and more particularly to a fluid-tight (airtight or watertight) slide fastener stringer.

2. Prior Art:

Airtight and watertight slide fastener stringers have been known which generally comprise a support tape made of a fluid-tight soft material, and a row of discrete coupling elements mounted on the tape along an inner longitudinal edge portion thereof; such tape margin is folded so as to provide therealong a contact portion engageable with a corresponding contact portion of a like companion stringer to effect a fluid-tightness between the two stringers. When the opposed coupling element rows of the two stringers are interengaged by a slider to close the fluid-tight slide fastener, the opposed contact portions are pressed tightly against one another. The common problem with this type of fluid-tight stringers is that, during their interengagement, the individual coupling elements are subjected to objectionable deformation or displacement due to undue stress induced by the tight pressing between the opposed contact portions and even by external forces exerted on the tapes. This objectionable deformation or displacement of the coupling elements not only causes non-smooth movement of the slider but also impairs fluid-tightness between the opposed stringers. U.K. Pat. No. 723,998, issued Feb. 16, 1955 to F. Mulka, is believed to exemplify the prior art.

SUMMARY OF THE INVENTION

According to the present invention, a fluid-tight slide fastener stringer comprises a support tape made of a fluid-tight soft material, and a row of discrete coupling elements mounted on the tape along an inner longitudinal edge portion thereof, such tape margin being folded so as to provide therealong a contact portion for fluid-tight engagement with a corresponding contact portion of a like companion stringer. Each of the coupling elements includes a base portion disposed on and extending transversely of the folded edge portion, and a coupling head portion extending from the base portion beyond the contact portion. The coupling head portion has a slot extending parallel to the general plane of the stringer transversely through the whole width of each coupling element and also extending longitudinally of the same coupling element into the base portion. The thus slotted coupling elements individually serve to absorb or reduce undue stress exerted thereon.

It is, therefore, an object of the invention to provide a fluid-tight slide fastener stringer which is free from objectionable deformation or displacement of the coupling elements, thus enabling both smooth movement of a slider and an improved fluid-tightness between the opposed companion stringers.

Many other advantages, features and additional objects of the present invention will become manifest to those versed in the art upon making reference to the detailed description and the accompanying drawings in which a preferred embodiment incorporating the principles of the present invention is shown by way of illustrative example.

DETAILED DESCRIPTION

Figure 1:
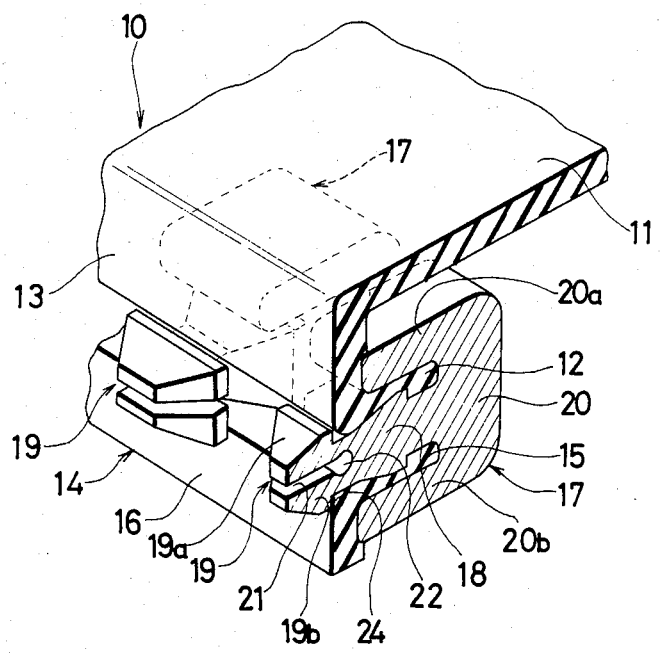
FIG. 1 is a fragmentary perspective view, partly in transverse cross section, of a fluid-tight slide fastener stringer according to the present invention.

The principles of the present invention are particularly useful when embodied in a fluid-tight slide fastener stringer (hereinafter referred to as "stringer") such as shown in FIG. 1, generally indicated by the numeral 10.

Figure 2:
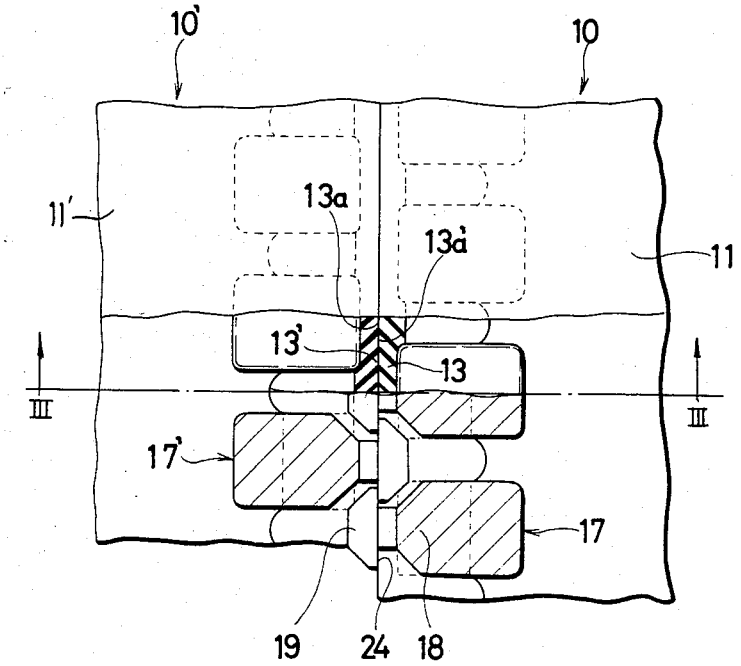
FIG. 2 is a fragmentary plan view, partially broken away, of the stringer of FIG. 1, showing the same having been interengaged with a like companion stringer.
Figure 3:
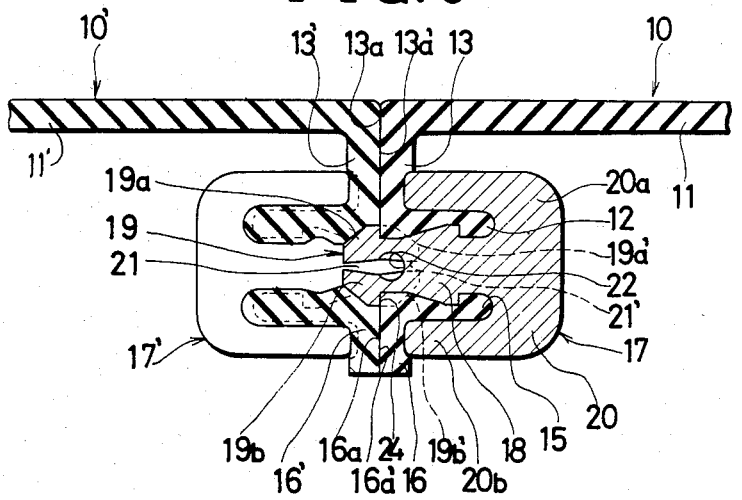
FIG. 3 is an enlarged, fragmentary transverse cross-sectional view taken along line III—III of FIG. 2.

The stringer 10 includes a support tape 11 made of a fluid-tight soft material such as natural or synthetic rubber, or made of natural or synthetic fibers coated with such a fluid-tight material. The tape 11 has an inner longitudinal margin folded through its whole length so as to provide a folded edge portion 12 and a contact portion 13 contiguous thereto. An auxiliary tape 14, which is made of the same fluid-tight material as the tape 11 and coextends lengthwise therewith, has a folded edge portion 15 and a contact portion 16. The two folded edge portions 12,15 are spaced apart facewise from one another, while the two contact portions 13,16 are laterally (vertically in FIGS. 1 and 3) spaced apart from one another. Alternatively, the auxiliary tape 14 may be an integral part of the tape 11. The contact portions 13,16 are adapted to engage corresponding contact portions 13',16' of a like companion stringer 10' (FIGS. 2 and 3) to effect a fluid-tightness, i.e. airtightness or watertightness, between the two stringers 10,10'.

A row of discrete coupling elements 17 is mounted on and along the folded edge portions 12,15 of the tapes 11,14; each coupling element 17 has a base 18, a coupling head 19 and a leg portion 20. The base portion 18 is sandwiched between the folded edge portions 12,15 and extends transversely thereof. The coupling head 19, in the form of an enlarged portion, extends from one end of the base portion 18 beyond the contact surfaces **13*a*,16*a* of the contact portions 13,16. The leg portion 20 includes a first and a second section 20*a*,20*b* extending so as to hold tightly the respective folded edge portions 12,15 between the first section 20*a* and the base portion 18 and between the latter and the second section 20*b*, respectively. The coupling elements 17** may be made of nickel steel, stainless steel, synthetic resin, or other suitable material.

When the opposed rows of coupling elements 17,17' of the two companion stringers 10,10' (FIGS. 2 and 3) are interengaged by means of a slider (not shown) to close the fluid-tight slide fastener, the opposed contact portions 13,13' are pressed tightly against each other's contact surface **13*a*',13*a* and, likewise, the opposed contact portions 16,16' are pressed against each other's contact surface 16*a*',16*a*, effecting a fluid-tightness between the opposed stringers 10,10'. During this interengagement, the individual coupling elements 17,17' are subjected to deformation or displacement due to stress induced by the tight pressing between the opposed contact portions 13,13' and 16,16' and even by external force exerted on the tapes 11,11'. In this type of fluid-tight slide fasteners, undue deformation or displacement causes nonsmooth movement of a slider. In order to absorb or reduce such undue stress, each coupling element 17,17' has a slot 21,21' extending parallel to the general plane of the stringers 10,10' transversely of the same coupling element through the width thereof, dividing each coupling head portion 19,19' into a first and a second half 19*a*,19*b*;19*a*',19*b*'. The slot 21,21' also extends longitudinally of each coupling element 17,17' beyond both the jaw 24 of the coupling head portion 19 and the contact surfaces 13*a*,16*a* of the tapes 11,14 into the base portion 18. The first and second halves 19*a*,19*b*; 19*a*',19*b*' are recoverably deformed independently of one another, when stress from the tape 11,11' is exerted on the individual coupling element 17,17'**, depending on the amount of the stress.

As better shown in FIG. 1, the slot 21,21' has in a free form a uniform thickness and terminates in an enlarged portion 22 (the corresponding enlarged portion of the companion stringer 10' is not illustrated for clarity) of circular cross section, allowing the first and second coupling head halves **19*a*,19*b*; 19*a*',19*b*'** to be recoverably deformed to an increased extent.

With the fluid-tight stringer 10 having the slotted coupling elements 17, it is possible to absorb or reduce undue stress exerted on the individual coupling elements 17 and to thereby prevent the coupling head portion 19 of each coupling element 17 and the contact portions 13,16 of the tapes 11,14 from being easily worn out or otherwise damaged, without impairing either smooth movement of a slider or fluid-tightness between the opposed stringers. Further, the slot 21 serves as an escape for any dust that would cause nonsmooth movement of a slider.

Although various minor modifications may be suggested by those versed in the art, it should be understood that I wish to embody within the scope of the patent warranted hereon, all such embodiments as reasonably and properly come within the scope of my contribution to the art.

What is claimed is:

1. A fluid-tight slide fastener stringer comprising:

(a) a support tape made of a fluid-tight soft material and having a longitudinal edge portion folded so as to provide therealong a contact portion adapted to engage a corresponding contact portion of a like companion stringer to effect a fluid-tightness between such two stringers; and (b) a row of discrete coupling elements mounted on and along the folded edge portion of said tape, each of said coupling elements having (1) a base portion disposed on an outer surface of said folded tape edge portion and extending transversely thereof, and (2) a coupling head portion extending from one end of said base portion beyond said contact portion of said tape, said coupling head portion having a slot extending parallel to the general plane of said stringer transversely through the width of each said coupling element and also extending longitudinally of each said coupling element into said base portion, said slot defining first and second coupling head halves recoverably deformable in response to stress applied by a mating stringer independently of each other.

2. A fluid-tight slide fastener stringer according to claim 1, said slot extending longitudinally of each said coupling element beyond a contact surface of said contact portion.

3. A fluid-tight slide fastener stringer according to claim 1, said slot terminating in an enlarged portion of circular cross section.

4. A fluid-tight slide fastener stringer according to claim 1, each said coupling element further having a leg portion extending from the other end of said base portion so as to hold said folded tape edge portion between said base and leg portions.

5. A fluid-type slide fastener stringer according to claim 3, each said coupling element further having a leg portion extending from the other end of said base portion so as to hold said folded tape edge portion between said base and leg portions.

6. A fluid-tight slide fastener stringer according to claim 2, said slot terminating in an enlarged portion of circular cross section.

7. A fluid-tight slide fastener stringer according to claim 2, each said coupling element further having a leg portion extending to the other end of said base portion so as to hold said folded tape edge portion between said base and said leg portions.

* * * * *